US005294044A

United States Patent [19]

Clark

[11] Patent Number: 5,294,044

[45] Date of Patent: Mar. 15, 1994

[54] FIBERBOARD BOX WITH REINFORCED CORNERS

[76] Inventor: Danny W. Clark, 4402 Southfield Dr., Baltimore, Md. 21236

[21] Appl. No.: 35,041

[22] Filed: Mar. 22, 1993

[51] Int. Cl.[5] ..... B65D 5/50

[52] U.S. Cl. ..... 229/191; 229/149; 229/918; 229/919

[58] Field of Search ..... 229/143, 149, 150, 174, 229/191, 915, 918, 919, DIG. 11

[56] References Cited

U.S. PATENT DOCUMENTS

| | | | |
|---|---|---|---|
| 2,634,021 | 4/1953 | Cella . | |
| 3,270,943 | 10/1966 | Polenghi . | |
| 3,291,370 | 12/1966 | Elias | 229/143 |
| 3,713,579 | 1/1973 | Chaffers | 229/DIG. 11 |
| 3,935,991 | 2/1976 | Crane . | |
| 4,174,045 | 11/1979 | Heller et al. . | |
| 4,389,013 | 6/1983 | Hall et al. | 229/915 |
| 4,418,863 | 12/1983 | Kimbrell, Sr. | 229/143 |
| 4,497,408 | 2/1985 | Jes | 229/DIG. 11 |
| 4,613,045 | 10/1986 | Watson . | |
| 4,770,339 | 9/1988 | Weimer | 229/143 |
| 4,799,620 | 1/1989 | Vilella . | |
| 4,874,125 | 10/1989 | Bates | 229/DIG. 11 |
| 5,002,224 | 3/1991 | Muise | 229/DIG. 11 |

FOREIGN PATENT DOCUMENTS

| | | | |
|---|---|---|---|
| 103932 | 3/1966 | Denmark | 229/DIG. 11 |
| 1271481 | 8/1961 | France | 229/918 |
| 2194771 | 3/1988 | United Kingdom | 229/DIG. 11 |

*Primary Examiner*—Gary E. Elkins
*Attorney, Agent, or Firm*—Gordon K. Anderson

[57] ABSTRACT

A fiberboard box formed from a blank (20), which includes side panels (24 and 28), also top and bottom flaps (40, 42, 44 and 46), with a pair of outer end panels (26 and 30). Mating inner overlapped end panels (48 and 50) produce a double fiberboard thickness on each end. Each corner contains a doubled vertical reinforcement (64) at an equal bisecting angle integrally formed from each outer end panel and adjacent side panel. A diagonal corner reinforcement (68) is formed from each overlap end panel and is angularly bent to span between the end and side panels and is also contiguous with the doubled vertical reinforcement. The diagonal and doubled reinforcement combination in each corner is attached together with glue where they touch each other, creating a rigid weight bearing corner permitting other like boxes to be stacked on top. Optionally, a number of stacking tabs (52) are formed in the end panels with mating recesses (54) maintaining alignment when the completed boxes are stacked.

18 Claims, 3 Drawing Sheets

FIBERBOARD BOX WITH REINFORCED CORNERS

TECHNICAL FIELD

The invention relates to fiberboard boxes in general, and more specifically to a fiberboard box having reinforcing corners of triple material permitting stacking on top of each other without crushing.

BACKGROUND ART

Previously, many types of box structures have been used in endeavoring to provide an effective means for producing sufficient strength to permit stacking. Many attempts have been made to add a rigid structural member in each corner of a box to support the weight loading rather than utilizing the structural rigidity of the box itself. While this ancillary element served the purpose, its expense and assembly labor requirement has not completely solved the problem. Other inventions were directed to folding material over in the corners doubling the wall thickness, however, if the stack was not completely even, the strength in the corners was not evenly distributed, again not always fulfilling the need.

A search of the prior art did not disclose any patents that read directly on the claims of the instant invention. However, the following U. S. patents were considered related:

| U.S. Pat. No. | INVENTOR | ISSUE DATE |
|---|---|---|
| 2,634,021 | Cella | Apr. 7, 1953 |
| 3,270,943 | Polenghi | Sep. 6, 1966 |
| 3,935,991 | Crane | Feb. 3, 1976 |
| 4,174,045 | Heller et al | Nov. 13, 1979 |
| 4,613,045 | Watson | Sep. 23, 1986 |
| 4,799,670 | Vilella | Jan. 24, 1989 |

Cella, in U.S. Pat. No. 2,634,021, teaches a container construction for boxes, or crates, that are fabricated of sheet metal with a reinforcing angle-piece fitted into each corner. A lug projects f rom the top of the crate to intersect with a crate stacked on the top thereof. The sides are wood and riveted to the sheetmetal ends.

U.S. Pat. No. 3,270,943 of Polenghi discloses a paperboard container utilizing triangular shaped rods of wood or other material resistant to compressive stresses. Each rod has two blind holes, one in each end, in which a projection is placed in the top, one to align and hold the box to one stacked thereabove., The paperboard is cut-away for the projection and hole.

Cranes invention in U.S. Pat. No. 3,935,991 employs molded thermosetting plastic reinforcing end frames secured to outer sides of end walls of a paperboard container body permitting stacking. Tabs interlock with the lids, or cover panels, locking them closed allowing temporary opening for display of the produce within.

U.S. Pat. No. 4,174,045 of Heller et al teaches a metallic platform with supports to receive a like platform stacked on top. Side walls consist of steel plates that engage the corners and the bottom also include feet for resting the platform away from the ground.

Watson in U.S. Pat. No. 4,613,045 discloses a paperboard container that has the corners folded into a triangular shape with the stability of the corner reinforcements provided by interlocking tabs that are folded down and threaded through apertures cut into the top panels. The resulting reinforced corner then contains a double thickness material adjacent to the sides and ends and a single proximal corner reinforcement diagonally positioned across the corner. The rigid relationships provide stability and strength to a column of containers, however, two problems exist with this prior art. First, the requirement for threading a flap through an aperture to lock the corner in place is labor intense, as the paperboard must be bent by hand when inserted and forced in flush necessitating a tight radial bend making the procedure extremely time consuming. Second, the reinforced corner has only the single diagonal weight bearing member, as the other two are contiguous with the sides and ends and offer little or no support when stacked, whereas the instant invention contains three supports directly in the corner, all of which are away from the side and end panels and are weight bearing.

U.S. Pat. No. 4,799,620 of Vilella folds and assembles the box in a conventional manner, except at the corners where pillars are constructed by superimposing a series of double panels having two or three material thicknesses. The upper portion of each pillar is connected together with a cap of plastic material the shape of a prism with a triangular base having a solid bottom and opening to receive, like parts in a similar box stacked thereupon. The weight support is augmented by the plastic cap.

It will be noted that prior art has attempted to reinforce the corner of a box container by adding a secondary structural member or a single diagonal fold in the corners, however, none of the prior art found includes a combination of diagonal and doubled angular corners that unitedly support the weight of a box stacked on top.

DISCLOSURE OF THE INVENTION

The problem of providing a fiberboard box or container at a non-prohibiting cost, having sufficient structural integrity to support a stack of like items has been with us for some time. In order to increase the weight supporting ability, some type of reinforcement is mandatory and if it is added as a separate item to a fiberboard box, the labor to install and cost of the element itself is usually prohibitive.

It is, therefore, the primary object of the invention to provide a single-piece folded fiberboard box having no less than three separate contiguous vertical reinforcements in each corner. Two of these reinforcements are formed by a doubled member that is bent back into a "U" shape, and protrudes into the box interior at an equal bisecting angle. The third is formed by bending a diagonal corner reinforcement from the end panel and affixing it to the side panel with adhesive. The double member is bonded together with adhesive and the protruding end is bonded to the diagonal. This construction creates a large cross-sectional area that is structurally held together and located such that stacking need not be precise in order to transfer the weight to the corners, due to its large cross-sectional area.

An important object of the invention is the use of stacking tabs on the top of the box that are integrally formed in the doubled over end panels. As the tabs are located on the top of the box, the problem of having to bend the tabs out of the way if they were located on the bottom is eliminated, as is the case in some prior art.

Another object of the invention relates to the inventions ability to interlock the top f laps into the stacking tabs. This is accomplished by forming tabs on each end of the top panels and inserting a locking ear into an aperture in the tab.

Still another object includes flaps on both top and bottom of the box, also double f laps on the bottom f or maximum strength.

Yet another object of the invention is the use of only one piece construction of a paperboard, such as corrugated, cut with tooling well known in the art and readily available. Further, no special means of construction or folding techniques are required as any platen diecutter, such as a steel rule die or rotary die cutter may be used. Since no separate corners are required, the box may be shipped in the flat in a normal manner.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
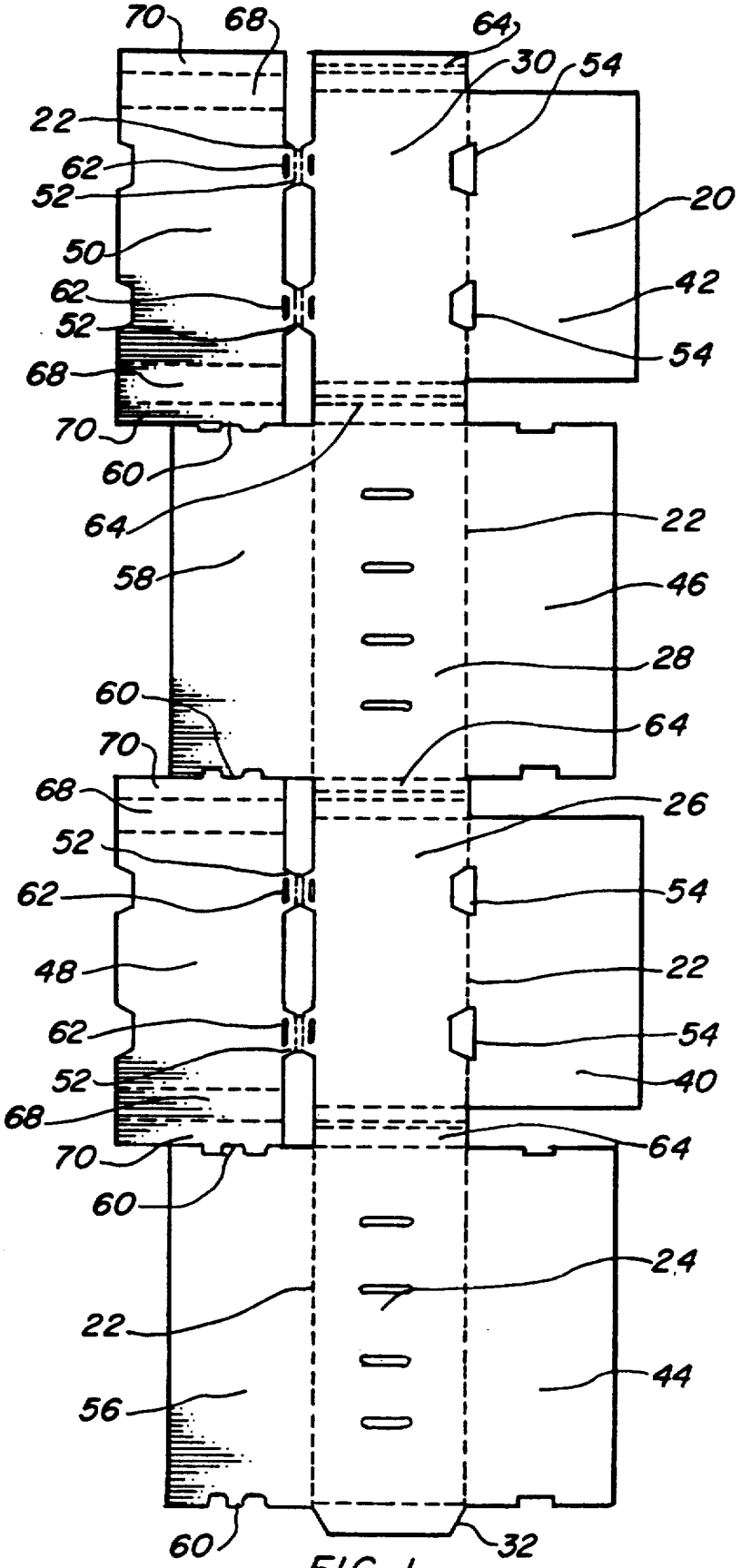
FIG. 1 is a plan view of the preferred embodiment shown in the flat after diecutting and creasing.
Figure 2:
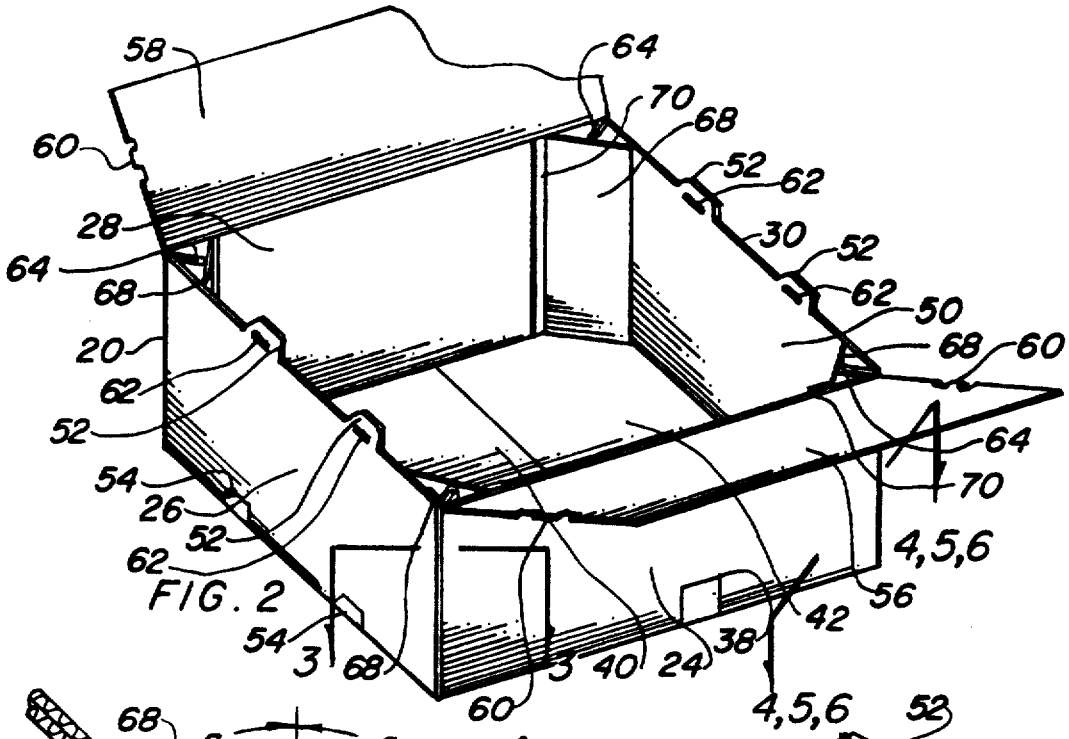
FIG. 2 is a partial isometric view of the preferred embodiment with the lid open illustrating the box and its interior.

The best mode for carrying out the invention is presented in terns of a preferred embodiment. This preferred embodiment is shown in FIGS. 1 through 8 and is comprised of a blank 20 of board that is scored, slotted and slitted in the flat. The blank is then folded into a box or container, as illustrated in the drawings. The blank 20 may be of any material suitable for the application, such as corrugated board in single wall, double wall or triple wall, also chipboard or the like.

The blank 20 is cut to the desired shape, as shown in FIG. 1 and is scored 22, as illustrated in dotted lines by crushing the material and leaving a slight indentation permitting the material to fold along the predetermined line.

Figure 4:
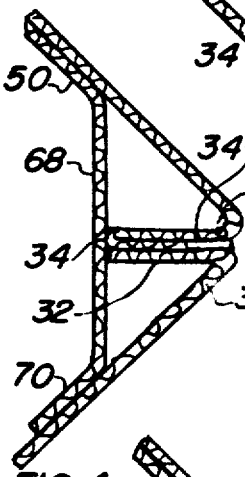
FIG. 4 is a cross-sectional view taken along lines 4—4 of FIG. 2 illustrating the glued closure means.
Figure 5:
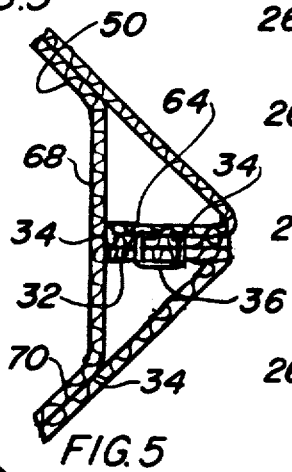
FIG. 5 is a cross-sectional view taken along lines 5—5 of FIG. 2 illustrating the stapled closure means.
Figure 6:
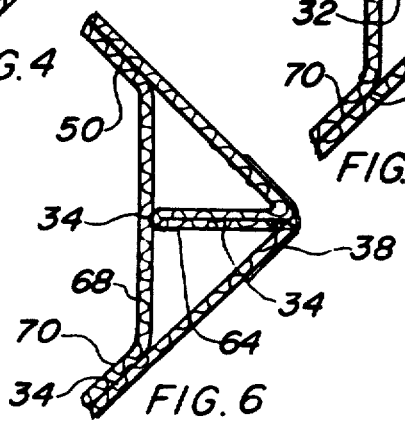
FIG. 6 is a cross-sectional view taken along lines 6—6 of FIG. 2 illustrating the butt joint and taped closure means.
Figure 7:
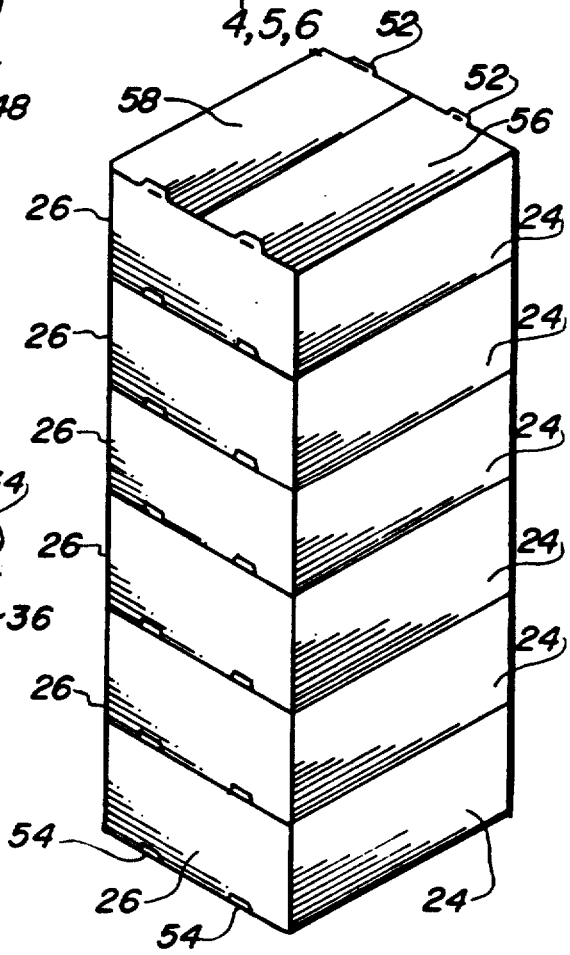
FIG. 7 is a partial isometric view of a stack of boxes interlocked together.
Figure 8:
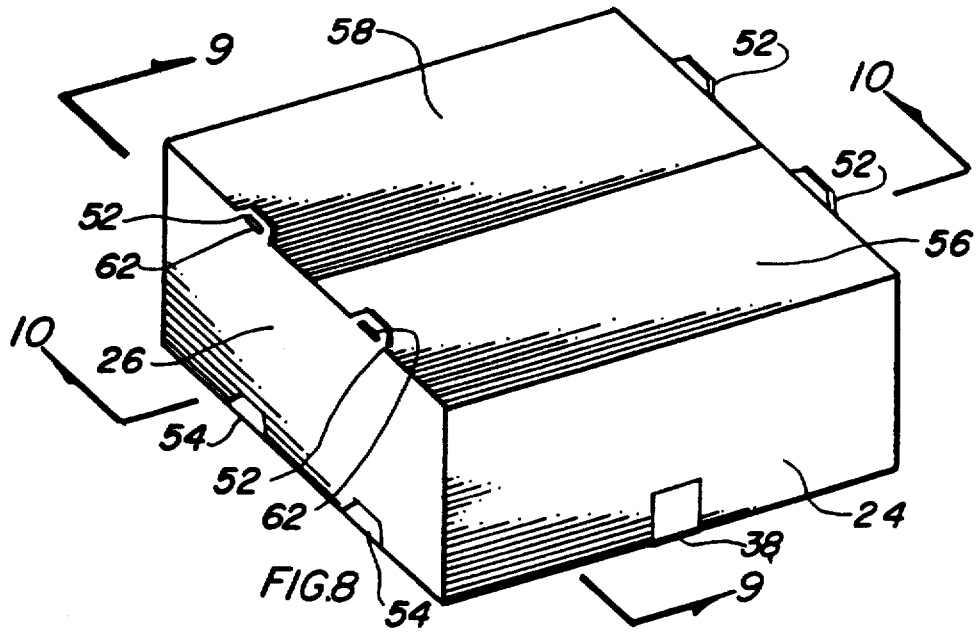
FIG. 8 is a partial isometric view of the preferred embodiment in a closed condition.
Figure 9:
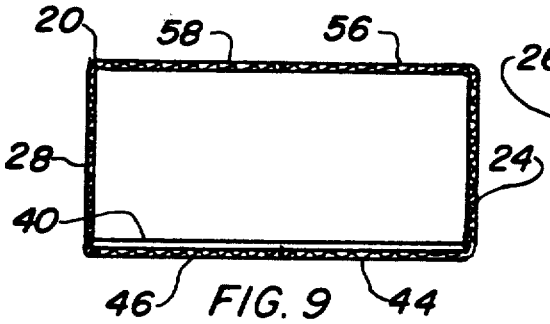
FIG. 9 is a cross-sectional view taken along lines 9—9 of FIG. 8 longitudinally of the box.
Figure 10:
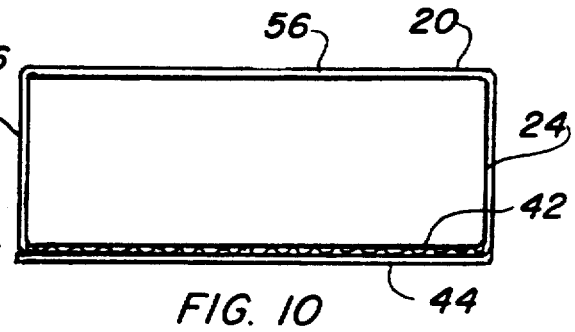
FIG. 10 is a cross-sectional view taken along lines 10—10 of FIG. 8 laterally of the box.
Figure 11:
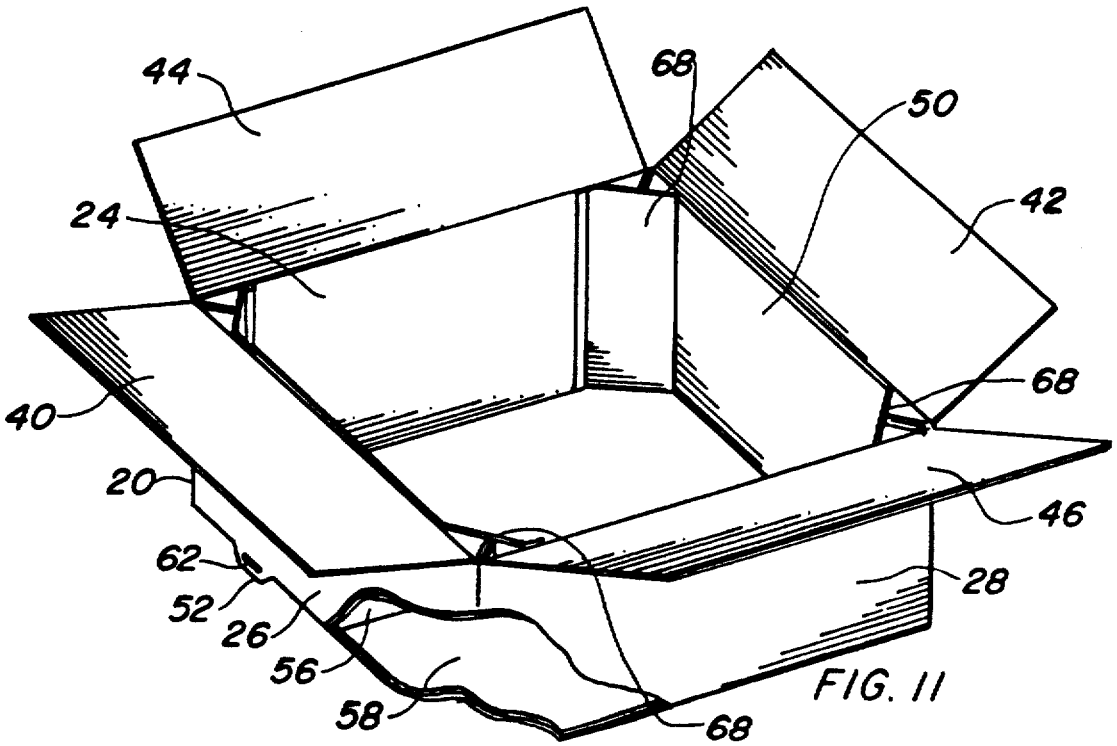
FIG. 11 is a partial isometric view of the invention turned completely upside down with the bottom flaps open and one of the sides cut-away to illustrate the closed top flaps.

A near side panel 24, left outer end panel 26, far side panel 28 and right outer end panel 30 are formed integrally from the blank contiguous with each other by folding upward, or at least at right angles to each other forming a rectangle. Closure means join the panels together, preferably as a joint tab 32 which is adjacent to and integral with the near side end panel 24 and overlaps the right outer end panel 30 on the inside of the rectangle. The tab 32 is attached with glue 34, as shown in FIG. 4, or staples 36, as illustrated in FIG. 5, retaining the blank 20 into the rectangular shape. Alternately, the closure means may be a butt joint between adjacent panels covered with tape 38, as illustrated in FIG. 6.

Bottom flaps are formed by bending contiguous material from the blank 20 upward along the scored lines 22 from each adjacent panel, i.e., a left inner bottom flap 40 contiguous with the left outer end panel 26, a right inner bottom flap 42 contiguous with the right outer end panel 30, a near outer bottom side flap 44 contiguous with the near side panel 24 and a far outer bottom side flap 46 contiguous with the far side panel 28. It will be noted that the inner flaps 40 and 42 are folded upward first forming an inner bottom and the outer flaps 44 and 46 overlap on the outside forming a double thickness bottom. This folding sequence may be easily reversed however, without deviating from the spirit of the invention.

Bottom attaching means joining the flaps 40, 42, 44 and 46 together is accomplished by either metallic staples 36 tape 38 or glue 34, all well known in the art.

The ends of the box may be overlapped to improve the strength and provide further support using material on each end to reinforce the corners. A left inner overlap end panel 48 is contiguous with the left outer end panel 26 and folded downward along a score line 22 to form a double thick end. Likewise, a right inner overlap end panel 50 touching the right outer end panel 30 is folded inside the rectangle to complete the other end.

The doubled end panels 26, 30, 48 and 50 are folded higher than the top of the box and are cut-away to leave at least one, preferably a pair of doubled stacking tabs 52 protruding above the box. These tabs 52 create a retaining stop on each end panel 26, 30 for holding similar boxes in line when stacked one on top of the other. A mating panel stacking tab recess 54 is cut out of each end panel 26 and 30 at the matching locations permitting the stacking tabs 52 to be enclosed within the appropriate recess 54 assuring alignment of each box stacked thereupon.

A near top flap 56 is formed from the blank adjacent to the near side panel 24 and folded downwardly to form the first half of the top and likewise a far top flap 58 contiguous with the far side panel 28 is folded downward to complete the top.

Joining means fasten the top together in the form of tape 38, or staples 36, illustrated in FIG. 5, or the top flaps 56 and 58 may contain a number of locking ears 60 along with the stacking tabs 52 containing locking ear apertures 62 permitting the ears 60 to penetrate the apertures 62 when the flaps are closed forming a top. The tabs 52 have sufficient resiliency to bend out of the way when the top flaps 56 and 58 are pushed down. The latter method of joining permits reuse of the box, or a combination of the above may be used for positive closure.

Figure 3:
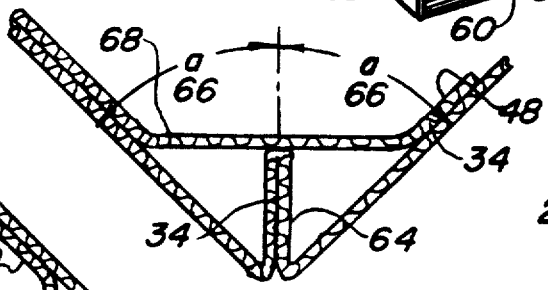
FIG. 3 is a cross-sectional view taken along lines 3—3 of FIG. 2 illustrating the reinforced corner.

The key to the weight bearing reinforced corners is found in the preferred embodiment wherein each corner contains a doubled over corner vertical reinforcement 64 formed from each outer end panel 26 and 30 and adjacent side panel 24 and 28. This corner vertical reinforcement 64 distends into the box at an equal bisecting angle 66 from the right angle intersection of the panels forming a double wall corner structural reinforcement. FIGS. 3 through 6 illustrate this member best in cross-section and FIG. 3 shows the equal bisecting angle with the alpha designation "a". It should be noted that while the corner is folded in this manner, the actual angle may vary somewhat and still accomplish the desired function depending on the tolerance of the layout in the flat and exactness of the bends.

Each corner further contains a diagonal corner reinforcement 68 that is formed from each overlap end panel 48 and 50. Each diagonal reinforcement 68 has an inside overlapped fastening tab 70 on the end thereof. The diagonal reinforcement 68 is angularly bent to span between the end and side panels 26, 30 and 24, 28 forming a triangular shaped inner corner with a double thickness of material bisecting the triangle shape. As the diagonal reinforcements 68 are formed integral with the end panels 26 and 30, the distal end is attached to each side panel 24 and 28, with mounting means which is preferably glue, as commonly used in the fiber box industry. If desired, the interface between the corner vertical reinforcement 64 and the diagonal reinforcement 68 may also be secured with glue to strengthen the corner and assure the position of the two reinforcing elements 64 and 68 at the bisecting angle 66.

While the drawings depict a variation of a center special slotted container designated by the International Box Code 0204, the invention may be adapted to a myriad of other styles, as the heart of the invention is in the vertical reinforced corners 64 made integrally with any side and end panels along with the diagonal reinforcement 68 formed from any overlapped panel. In all cases, the material, attaching, fastening, joining and mounting means are the same. Optionally, the stacking tabs 52 and locking ears 60 may also be employed in other styles of boxes in the combination described above.

While the invention has been described in complete detail and pictorially shown in the accompanying drawings, it is not to be limited to such details, since many changes and modifications may be made in the invention without departing from the spirit and scope thereof. Hence, it is described to cover any and all modifications and forms which may come within the language and scope of the appended claims.

I claim:

1. A fiberboard box with reinforced corners formed from a flat blank board, that is scored, slotted, and slitted, the box comprising:

a near side panel integrally formed from the blank folded upwardly at a right angle, a left outer end panel integrally formed from the blank contiguous with the near side panel folded upwardly at a right angle, a far side panel integrally formed from the blank contiguous with the left outer end panel folded upwardly at a right angle, a right outer end panel integrally formed from the blank contiguous with the far side panel folded upwardly at a right angle, closure means connecting said near side panel and said outer end panel into a rectangle, a left inner bottom flap integrally formed from the blank contiguous with the left outer end panel folded inwardly toward the panels, a right inner bottom flap integrally formed from the blank contiguous with the right outer end panel folded inwardly towards the panels, a near outer bottom side flap integrally formed from the blank contiguous with the near side panel folded inwardly therefrom overlapping the inner bottom flaps, a far outer bottom side flap integrally formed from the blank contiguous with the bar side panel folded inwardly therefrom overlapping the inner bottom flaps, the flaps jointly forming a bottom, bottom attaching mean joining the bottom flaps together into a structural bottom, a left inner overlap end panel integrally formed from the blank contiguous with the left outer end panel folded inside the left outer end panel producing a double thickness end, a right inner overlap end panel integrally formed from the blank contiguous with the right outer end panel folded inside the right outer end panel producing a double thickness end, a near top flap integrally formed from the blank contiguous with the near side panel folded inwardly to produce a first half of a top, a far top flap integrally formed from the blank contiguous with the far side panel folded inwardly to produce a second half of a top, joining means fastening the top flaps one with the other where they butt together forming a top, a doubled corner vertical reinforcement formed integrally from the outer end panels and adjacent side panel, distending into the box at an equal bisecting angle from each right angle intersection of the panels forming a double wall corner structural reinforcement, a plurality of diagonal corner reinforcements integrally formed from the overlap end panels further, each diagonal corner reinforcement having an inside overlapped fastening tab distal therewith, angularly bent to span between the end and side panels contiguous with the doubled corner vertical reinforcements and the fastening tab attached to the side panels with mounting means, the doubled reinforcements further forming triple structural reinforcing corners permitting additional boxes to be stacked thereon without corner crushing.

2. The fiberboard box as recited in claim 1 wherein said blank further comprises corrugated board.

3. The fiberboard box as recited in claim 1 wherein said blank further comprises chipboard.

4. The fiberboard box as recited in claim 1 wherein said closure means comprise joint tabs glued to the corner vertical reinforcements.

5. The fiberboard box as recited in claim 1 wherein said closure means comprise joint tabs stapled to the corner vertical reinforcements.

6. The fiberboard box as recited in claim 1 wherein said closure means comprise a butt joint between said panels that are adjacent each covered with tape secured with adhesive.

7. The fiberboard box as recited in claim 1 wherein said bottom attaching means comprise metallic staples.

8. The fiberboard box as recited in claim 1 wherein said bottom attaching means comprise tape secured with adhesive.

9. The fiberboard box as recited in claim 1 wherein said joining means for fastening the top flaps comprise tape secured with adhesive.

10. The fiberboard box as recited in claim 1 wherein said joining means comprise glue disposed between contiguous surfaces.

11. The fiberboard box as recited in claim 1 further comprising, a plurality of doubled stacking tabs formed integrally with the end panels and overlap end panels disposed above the top flaps creating a retaining stop on the end panels holding additional boxes together when stacked one on top of the other, also said outer end panels having a plurality of panel stacking tab recesses cut out of the outer end panels in aligned locations such that the stacking tabs mates within a recess assuring alignment of additional stacked boxes.

12. The fiberboard box as recited in claim 11 wherein said joining means for fastening the top flaps further comprise, two locking ears cut into two of four top flap edges and the stacking tabs having a locking ear aperture therein such that when the top flaps are bent inwardly, the ears may be inserted into the apertures thus joining the flaps in place wit the overlapped end panels.

13. The fiberboard box with reinforced corners formed form a blank of corrugated folded into side panels, top flaps, and bottom flaps the box comprising:

a pair of outer end panels, one on each end of the box formed for the blank contiguous with the box side panels, an inner overlap end panel integrally formed from the outer end panels folded downwardly inside the box producing a double fiberboard thickness on the ends of the box, a doubled corner vertical reinforcement formed integrally from the outer end panels distending into the box at an equal bisecting angle from a right angle intersection of the panels forming a double wall corner structural reinforcement, a plurality of diagonal corner reinforcements integrally formed from the overlap end panels further, each diagonal corner reinforcement having an inside overlapped fastening tab distal therewith, angularly bent to span between the end panels and box sides contiguous with the doubled corner vertical reinforcements and attached to the side panels with mounting means, the doubled and diagonal reinforcements forming triple structural reinforcing corners permitting additional boxes to be stacked thereon without corner crushing.

14. The fiberboard box as recited in claim 13 wherein the blank further comprises corrugated board.

15. The fiberboard box as recited in claim 13 wherein the blank further comprises chipboard.

16. The fiberboard box as recited in claim 13 wherein said mounting means comprise glue disposed between contiguous surfaces.

17. The fiberboard box as recited in claim 13 further comprising, a plurality of doubled stacking tabs formed integrally with the end panel and overlap end panel disposed above the top creating a retaining stop on the end panels holding additional boxes together when stacked one on top of the other, also said outer end panels having a plurality of panel stacking tab recesses cut out of the outer end panels in aligned locations such that the stacking tabs mates within a recess assuring alignment of additional stacked boxes.

18. The fiberboard box as recited in claim 17 further comprising joining means for attachably joining the top to the box, the flaps further having two locking ears cut into two of four flap edges and the stacking tabs having a locking ear aperture therein such that when the top flaps are bent inwardly the ears may be inserted into the apertures, thus joining the flaps in place with the overlapped end panels.

* * * * *